US011199305B2

(12) United States Patent
Xu et al.

(10) Patent No.: US 11,199,305 B2
(45) Date of Patent: Dec. 14, 2021

(54) LINE SOURCE LIGHTING SYSTEM

(71) Applicants: Self Electronics Co., Ltd., Zhejiang (CN); Wanjiong Lin, Zhejiang (CN); Self electronics USA Corporation, Norcross, GA (US)

(72) Inventors: Kai Xu, Zhejiang (CN); Huangfeng Pan, Zhejiang (CN); Jianguo Dong, Zhejiang (CN); Zuping He, Zhejiang (CN); Xiaoyun Liu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/690,779

(22) Filed: Nov. 21, 2019

(65) Prior Publication Data

US 2021/0048164 A1 Feb. 18, 2021

(30) Foreign Application Priority Data

Aug. 13, 2019 (CN) ..... 201910741855.2

(51) Int. Cl.

| | |
|---|---|
| ***F21V 5/00*** | (2018.01) |
| ***F21V 5/04*** | (2006.01) |
| ***F21Y 103/10*** | (2016.01) |
| *F21Y 115/10* | (2016.01) |

(52) U.S. Cl.

CPC ..... *F21V 5/007* (2013.01); *F21V 5/004* (2013.01); *F21V 5/043* (2013.01); *F21Y 2103/10* (2016.08); *F21Y 2115/10* (2016.08)

(58) Field of Classification Search

CPC ..... F21V 5/007; F21V 5/004; F21V 5/043; F21Y 2103/10

See application file for complete search history.

(56) References Cited

U.S. PATENT DOCUMENTS

| | | | | |
|---|---|---|---|---|
| 9,777,908 | B1 * | 10/2017 | Churnock | F21V 21/04 |
| 2008/0084693 | A1 * | 4/2008 | Shimada | F21S 8/04 362/240 |
| 2011/0032701 | A1 * | 2/2011 | Zhang | F21V 5/04 362/244 |
| 2011/0199005 | A1 * | 8/2011 | Bretschneider | H05B 41/02 315/152 |
| 2013/0010230 | A1 * | 1/2013 | Matsuki | G02F 1/133603 349/64 |
| 2015/0036114 | A1 * | 2/2015 | Schadt | H01L 25/0753 355/67 |

(Continued)

*Primary Examiner* — Anabel Ton

(74) *Attorney, Agent, or Firm* — Wang Law Firm, Inc.

(57) ABSTRACT

A line source lighting system including the following: lamp holder; printed circuit board; a plurality of point light sources; at least one lens, located in a light-emitting direction of the point light source for adjusting the light distribution of the point light source on a plane perpendicular to the length direction of the lamp holder; strip-shaped convex lens array, arranged along the length direction of the lamp holder for converting each point light source into a plurality of continuous sub-point light sources, the sub-point light sources converted by the adjacent point source is connected or coincident. the invention adopts a strip-shaped convex lens array for diffusing light from the point source only in the length direction of the lamp holder to form a line source, which can well prevent the light from diffusing in multiple directions, so that the line source get purified.

19 Claims, 13 Drawing Sheets

(56) References Cited

U.S. PATENT DOCUMENTS

| | | | | |
|---|---|---|---|---|
| 2016/0109068 | A1* | 4/2016 | Boonekamp | F21V 3/04 362/218 |
| 2018/0178247 | A1* | 6/2018 | Aizawa | H01L 33/62 |
| 2019/0204529 | A1* | 7/2019 | Yu | G02B 19/0061 |

* cited by examiner

LINE SOURCE LIGHTING SYSTEM

RELATED APPLICATION

This application claims priority to a Chinese Patent Application No. CN 201910741855.2, filed on Aug. 13, 2019.

FIELD OF THE TECHNOLOGY

The present invention relates to lighting technology field, with particular emphasis on a line source lighting system.

BACKGROUND OF THE INVENTION

At present, LED lamps on the market mainly use point light source lighting. This type of illumination has problems of glare and reflection glare. In order to solve the above problems, researchers try to replace the point light source with line light source generally by adopting a method of adding a diffusion lamp cover. The diffusion lamp cover diffuses the light from the LED. Since the diffusion direction is not single that the linear light source imaging is messy and fuzzy. The formed linear light source is directly used to illuminate the illuminated surface. The light distribution effect is not good, and the energy attenuation is more, making the formed line light source dim and messy. Finally the illumination on the illuminated surface is uneven, resulting in poor lighting effect.

At the same time, the existing improved line source lamps are either bulky, or in order to achieve the line source effect, the LED lamps used are more numerous, which increases the production cost.

BRIEF SUMMARY OF THE INVENTION

In view of this, the present invention provides a line source lighting system to solve the above technical problems.

A line source lighting system, comprising:

lamp holder;

printed circuit board, disposed on the lamp holder;

a plurality of point light sources, disposed spaced apart from each other along the length direction of the lamp holder on a light source mounting surface of the printed circuit board;

and at least one lens, disposed on the lamp holder and located in a light-emitting direction of the point light source for adjusting the light distribution of the point light source on a plane perpendicular to the length direction of the lamp holder;

further comprising:

strip-shaped convex lens array, disposed on the lamp holder and located in the light-emitting direction of the point light source and arranged along the length direction of the lamp holder for converting each point light source into a plurality of continuous sub-point light sources, the sub-point light sources converted by the adjacent point source (300) is connected or coincident.

For ease of manufacture, advantageously, the strip-shaped convex lens array is a positive cylindrical lens array.

When the strip convex lens array is a positive cylindrical lens array, the structure is a plane. In order to adapt to different lamp structures, advantageously, the strip-shaped convex lens array is a curved surface that is curved in the length direction of the strip-shaped convex lens. The strip-shaped convex lens array can be used directly as a lamp cover.

For ease of manufacture and for the sake of size, advantageously, the strip-shaped convex lens array is a positive cylindrical lens microarray disposed on an optical film.

For easy fixing and installation, advantageously, the strip-shaped convex lens array is located between the lens and the printed circuit board.

To reduce the size, increase the distance between the strip-shaped convex lens array and the point light source in the case of limited size, advantageously, the lens is located between the strip-shaped convex lens array and the printed circuit board.

Advantageously, at least two lenses are provided and the strip-shaped convex lens array is located between any two lenses.

To further increase the distance between the strip-shaped convex lens array and the point light source, advantageously, the strip-shaped convex lens array is disposed as a lamp cover.

In order to make the structure more compact, advantageously, the strip-shaped convex lens array and the lens are integrally formed.

To maximize the distance between the strip-shaped convex lens array and the point light source, advantageously, the strip-shaped convex lens array is disposed on a surface on which the light emitting surface of the lens is located.

To improve the effect of forming a line light source, advantageously, the strip-shaped convex lens array is disposed on the surface where the light incident surface of the lens is and on the surface where the light emitting surface is.

In order to improve the light distribution effect and meet different customer requirements, advantageously, the lens comprises a light transmission main part for focusing most of the light of the point light source, and a light transmission secondary part disposed at a certain angle with one side of the light transmission main part to guide a small part of the light of the point light source.

To improve the uniformity of the light, advantageously, the light transmission main part projects a majority of the light to the distal end of the illuminated surface, and the light transmission secondary part directs a small part of the light to the proximal end of the illuminated surface.

To improve the uniformity of the light, advantageously, on a plane perpendicular to the length direction of the lamp holder, the light incident surface of the light transmission secondary part and the light incident surface of the light transmission main part are straight lines, and the angle formed by the intersecting straight lines is 90°~160°.

In order to get the effect of a line light source at all angles, advantageously, the light incident surface of the light transmission secondary part is provided with the strip-shaped convex lens array, and the light incident surface and the light emitting surface of the light transmission main part are each provided with the strip-shaped convex lens array.

According to different requirements, the matched point light source and lens can be equipped with multiple groups, advantageously, the printed circuit board provided with the plurality of point light sources is symmetrically arranged with two pieces, correspondingly, the lenses are two symmetrical ones.

In order to increase the beam angel of light, advantageously, the angle between the optical axes of the point light sources on the two printed circuit boards is obtuse.

The shape of the lens can be designed according to the light output effect. In order to improve the uniformity of the light output, advantageously, the lens is a polarized lens.

Advantageously, the lens is a symmetrical lens.

Advantageously, on the plane perpendicular to the length direction of the LED light fixture, the reflection wall is provided on both sides of the point light source for reflecting the lateral light from the point light source to the light incident plane of the strip-shaped convex lens array.

Specifically, the line source lighting system of the present invention is a line source lighting lamp, including lamp holder;

printed circuit board, disposed on the lamp holder;

a plurality of point light sources, disposed on the light source mounting surface of the printed circuit board along the length direction of the line source lighting lamp;

Also included is the line source lighting system described above.

For ease of manufacture and installation, advantageously, the lamp holder includes two end seats, a strip base and a strip bed plate.

For ease of manufacture and installation, advantageously, the lens is clasped with the strip base.

In order to make the structure more compact, advantageously, the lens and the strip bed plate are integrally formed and formed into a closed mounting cavity in cross section.

In order to further improve the light utilization rate, advantageously, the point light source is provided with reflective walls on both sides thereof, and the lens, the reflective wall and the strip bed plate are integrally formed and formed into a closed mounting cavity in a cross section.

In order to make the structure more compact and convenient to manufacture and install, advantageously, the two ends of the strip base are connected with the end seat to form a first accommodating cavity. The strip bed plate is located at the bottom of the first accommodating cavity, and the strip bed plate is connected with the end seat to form a second accommodating cavity.

Advantageously, the reflection wall is located above the printed circuit board and on either side of the point light source. The inner side of the upper end of the strip base is provided with a first mounting groove. The outer side of the reflection wall is provided with a convex edge matching with the first mounting groove.

Advantageously, the second accommodating cavity is provided with the printed circuit board.

Advantageously, a reflection wall integrally formed with the strip bed plate is further provided.

Advantageously, the inner side of the top of the two reflection walls is provided with a first mounting groove for fixing the strip-shaped convex lens array.

Advantageously, the outer side of the top of the two reflection walls is provided with a snap structure for fixing the lens, and the bottom of the strip bed plate is provided with a second mounting groove for fixing the printed circuit board.

Advantageously, the strip-shaped convex lens array is disposed on the top end of the reflection wall.

In order to guide the deflecting rays to the strip-shaped convex lens array as much as possible, advantageously, the reflection walls are disposed at an obtuse angle with the mounting surface of the point light source.

In the context of energy saving and environmental protection, LED lamps are increasingly used in home and commercial lighting fields because of their high light extraction efficiency and good light collecting performance, advantageously, the point light source uses LED chips.

Technical Effects of the Present Invention

The line source lighting system and the line source lighting lamp of the present invention adopt a strip-shaped convex lens array that diffuses light from the point light source only in the length direction of the lamp holder to form a line source, so that the illumination surface of the line source lighting lamp has the same illumination intensity in the longitudinal direction. The improvement of the property can prevent the light from diffusing in multiple directions, so that the line light source is purified, and the lens is arranged to perform light distribution in the other direction to the line light source, thereby reducing energy attenuation and secondary light distribution of the lens. The function can achieve uniform distribution of light as needed, so that the illumination uniformity tends to 1, thereby improving the light-sweeping effect.

BRIEF DESCRIPTION OF THE DRAWINGS

Embodiments of the present invention are described below in conjunction with the accompanying drawings, as follows.

DETAILED DESCRIPTION OF THE INVENTION

Figure 1:
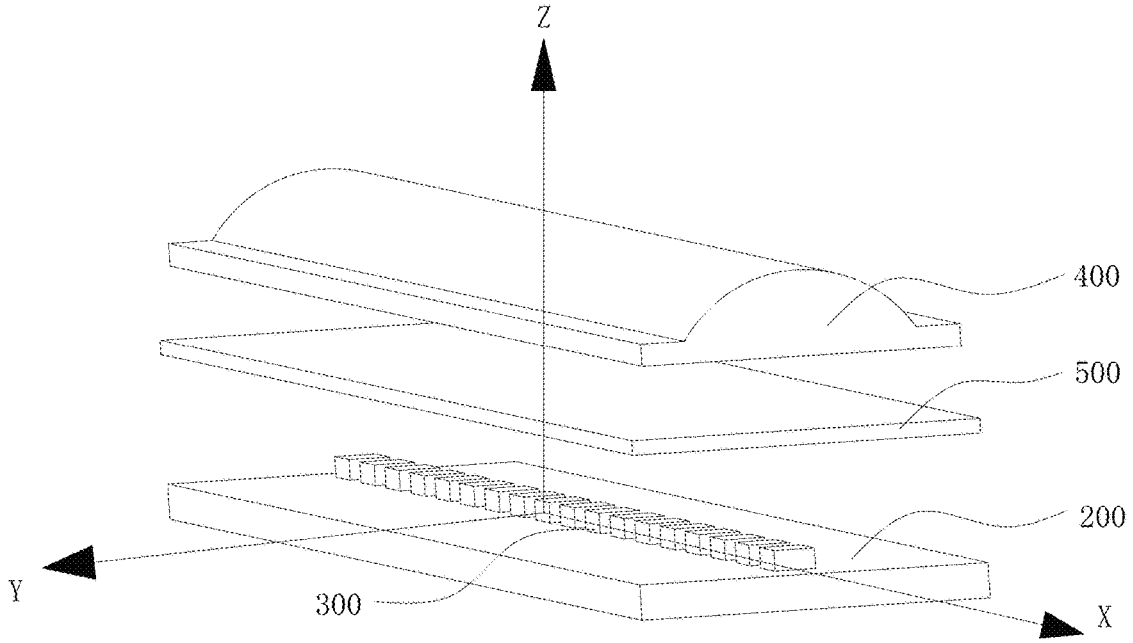
FIG. 1 is a schematic view showing the principle structure of a line source lighting system of the first embodiment.

Specific embodiments of the present invention will be further described in detail below based on the drawings. It should be understood that the description of the embodiments herein is not intended to limit the scope of the invention.

Embodiment 1

As shown in FIG. 1 to 6, the line source lighting system of the present embodiment comprises lamp holder 100, printed circuit board 200, a plurality of point light sources 300, lens 400 and strip-shaped convex lens array 500 and reflection wall 600.

The lamp holder 100 is used for fixing and mounting, and can be assembled by a plurality of components according to installation requirements, or can be a single component. In this embodiment, the lamp holder 100 comprises two end seats 101, a strip base 102 and a strip bed plate 103. Wherein, the strip base 102 is arranged at the bottom as a part of the lamp holder and is generally made of aluminum alloy for fixing installation and heat dissipation, the strip bed plate 103 is arranged above the strip base 102 for mounting printed circuit board 200 and other structures, in the actual assembly, the strip bed plate 103 can be set separately, in order to reduce the volume and make the structure compact, it can also be connected to the strip base 102 after forming with the lens 400, Or it can be formed in one piece with the strip base 102. However, the strip base 102, lens 400 and strip bed plate 103 are separately arranged in this embodiment. Both ends of the strip base 102 are fixedly connected to the end seats 101. The strip base 102 is provided with a cavity for accommodating the printed circuit board 200, the lens 400, and the reflection wall 600. The printed circuit board 200, the lens 400 and the reflection wall 600 can be fixed by screws, glue and clasp structure. In this embodiment, the two ends of the strip base 102 are connected with the end seat 101 to form a first accommodating cavity 108. The strip bed plate 103 is located at the bottom of the first accommodating cavity 108, and the strip bed plate 103 is connected with the end seat to form a second accommodating cavity 109. The second accommodating cavity 109 is provided for accommodating the printed circuit board 200 and the reflection wall 600. The reflection wall 600 is located above the printed circuit board and on either side of the point light source. The inner side of the upper end of the strip base 102 is provided with a first mounting groove 105. The outer side of the reflection wall 600 is provided with a convex edge 601 matching with the first mounting groove 105. The strip-shaped convex lens array 500 is arranged on the top end of the reflection wall 600, and the Lens 400 fits with the strip base 102 by clamping.

A plurality of point light sources 300 are spaced apart from each other along the length direction of the lamp holder on the light source mounting surface of the printed circuit board 200. Thus, the visual effect of the discontinuous point light source is formed. In the background of energy saving and environmental protection, the LED lamp is more and more applied to the home and commercial lighting field due to its high light extraction efficiency and good light collecting performance, and the point light source 300 is adopted LED chip.

In this embodiment, the optical axis direction of the point light source 300 is set as the z direction, and the mounting surface of the point light source 300 is a plane perpendicular to the z direction. On the mounting surface, the point light source 300 is arranged in the x direction, and y direction is perpendicular to the x direction. The printed circuit board 200 is also disposed on the mounting surface, and the xyz coordinate system can define an x-y plane, a y-z plane, and an x-z plane.

The lens 400 is disposed on the lamp holder 100, and the number thereof can be set according to the light distribution effect to be achieved, and can be one or more. In general, a single lens can complete the light distribution effect that needs to be achieved, specifically, the lens 400 is connected with the strip base 102 by clasping and located in a light-emitting direction of the point light source 300 for adjusting the light distribution of the point light source 300 on the plane (y-z plane) perpendicular to the length direction of the lamp holder, that is, the dimming in a single plane, and the lens 400 can be easily manufactured by extrusion process or other ways. Since the light distribution of the LED chip itself is not uniform, this causes the linear light source imaged by the strip-shaped convex lens array 500 to have a region with strong brightness and weak brightness. It is easy to understand that the less luminous areas emitted light with less energy, while the more luminous areas emitted light with more energy. In order to make the final emergent light evenly distributed, the lens 400 preferably adopts an asymmetric lens, and the light in the weak brightness region of the linear light source is emitted from the part of the asymmetric lens that has a strong ability to focus light, while the light in the strong brightness region is emitted from the part of the asymmetric lens that has a weak ability to focus light, in this way, the consistent effect of the emergent light can be reasonably achieved. However, this does not mean that the lens 400 can only adopt an asymmetrical form, and a symmetrical form can also be used. In this case, the brightness of the two ends of the linear light source is brighter, and the brightness toward the middle position is weaker. When a symmetrical lens is used, the middle protruding portion of the lens 400 corresponds to the middle position of the linear light source, and both ends correspond to both ends of the linear light source, so that the light can be uniform. Additionally, the lens 400 can also take the form of an optical film. When the lens 400 is an optical film, the lens 400 and the strip-shaped convex lens array 500 are integrated on the same optical film, and the optical film stretches the point light source into a line source in the x direction, and performs light distribution control on the point light source in the y-z plane.

Figure 2:
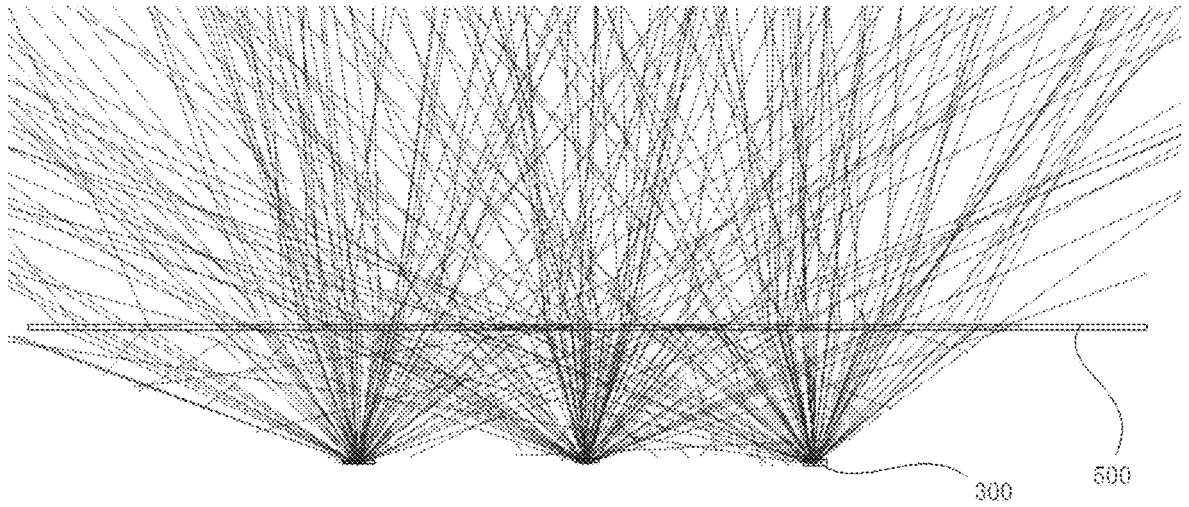
FIG. 2 is a schematic view showing the direction of light rays in the length direction of the line source lighting system of the first embodiment.
Figure 3:
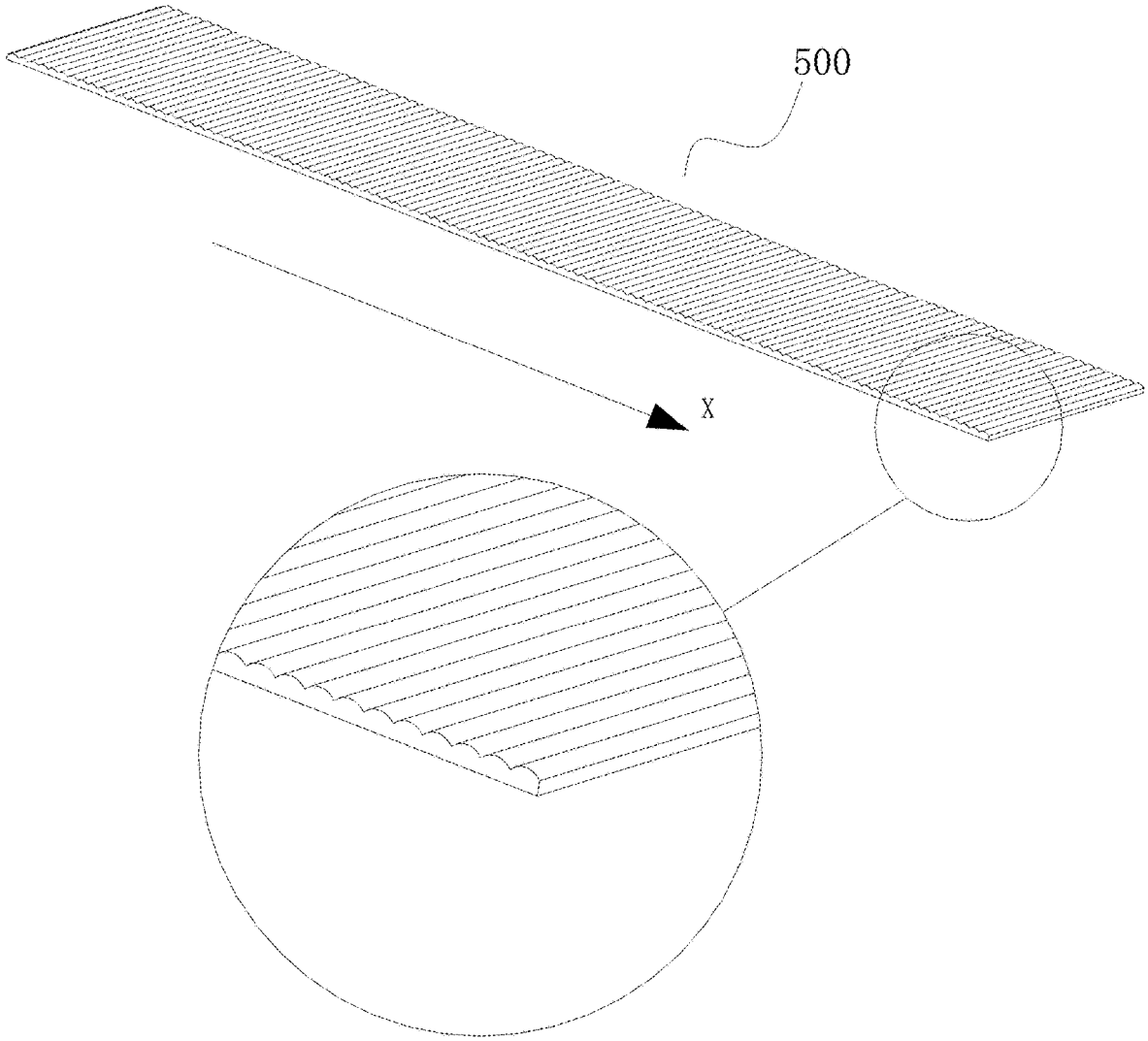
FIG. 3 is a schematic structural view of a positive cylindrical lens array.
Figure 4:
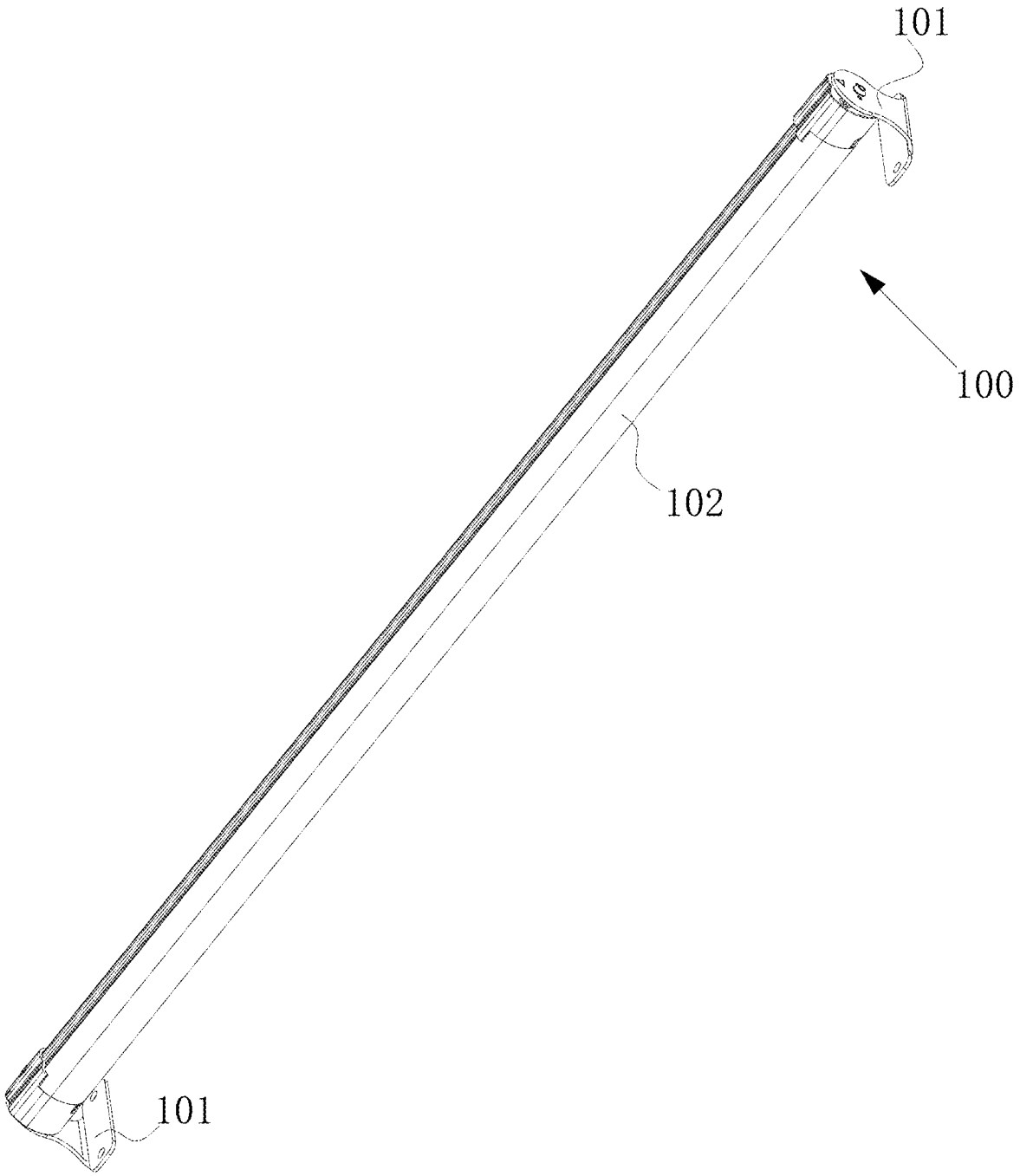
FIG. 4 is a three-dimensional structure diagram of the line source lighting system of the first embodiment.
Figure 5:
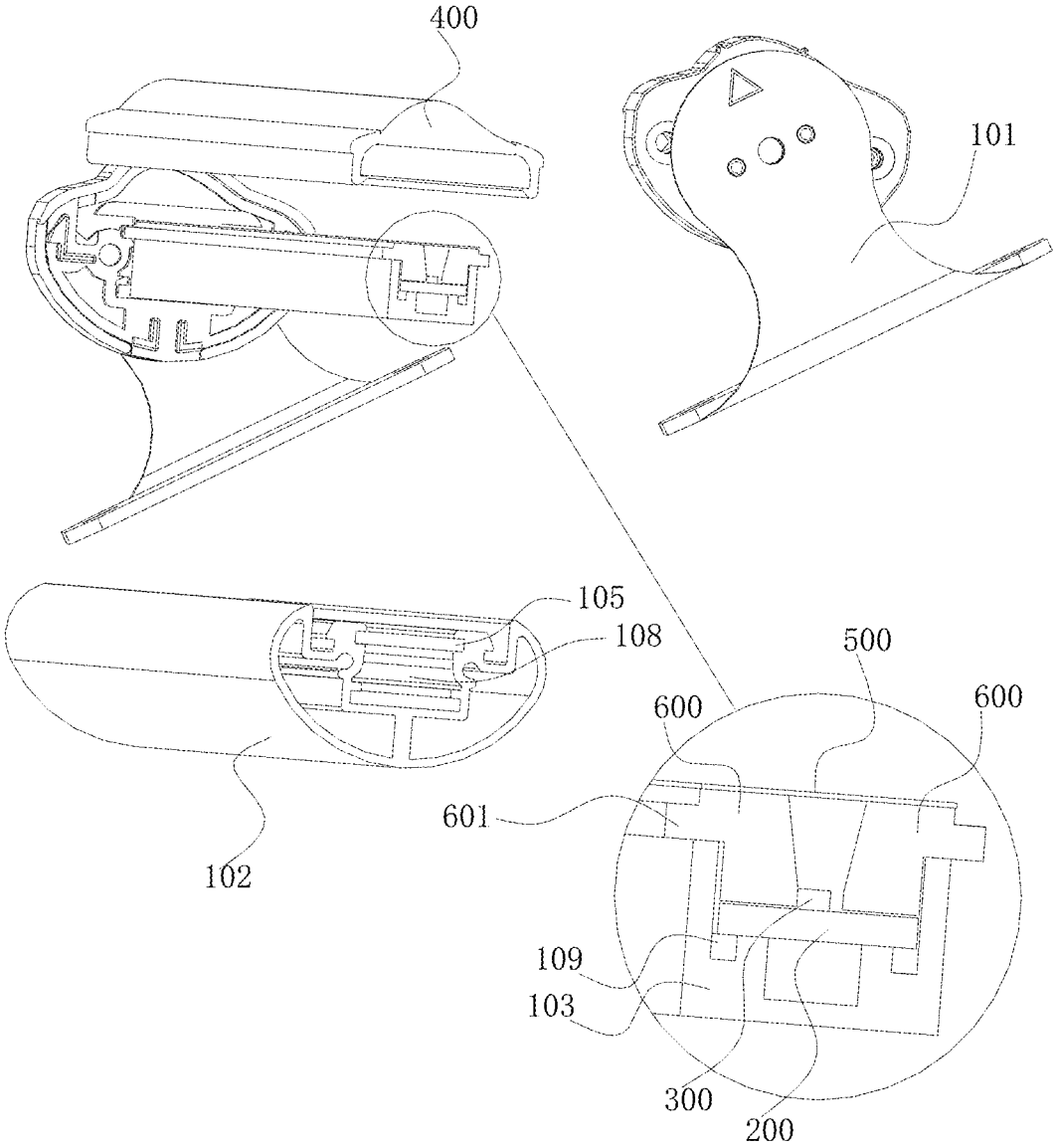
FIG. 5 is a schematic view showing the internal structure of the line source lighting system of the first embodiment.
Figure 6:
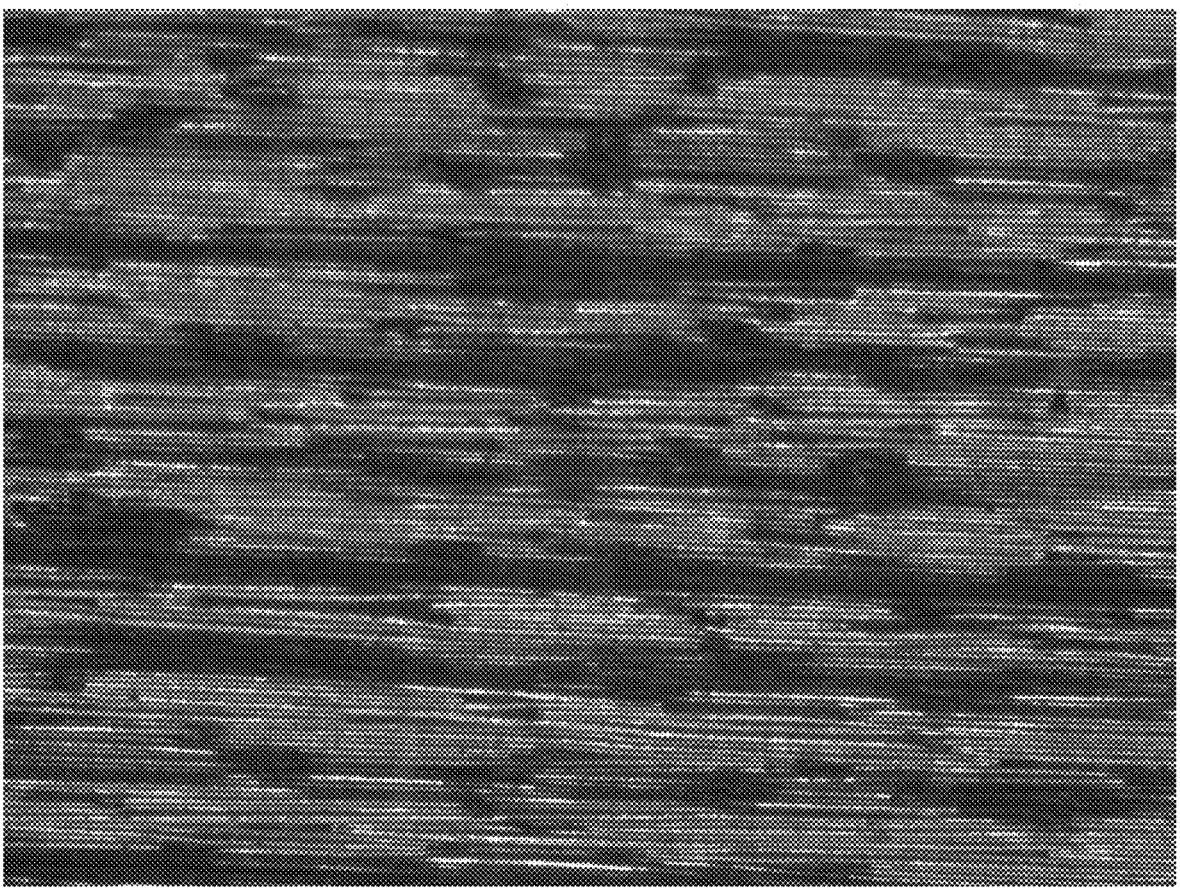
FIG. 6 is an enlarged view of an elliptical light diffusion film used in the first embodiment.

The strip-shaped convex lens array 500 is disposed on the lamp holder 100 and located between the lens 400 and the printed circuit board 200. The strip-shaped convex lens array 500 is arranged along the length direction of the lamp holder 100 for converting each point light source 300 into a plurality of continuous sub-point light sources, the sub-point light sources converted by the adjacent point source 300 is connected or coincident. It can be seen that before using the strip-shaped convex lens array 500, the point light sources 300 are still point light sources after passing through the lens 400 and become linear light sources while adding the strip-shaped convex lens array 500 they, as shown in FIG. 2.

The strip-shaped convex lens in the strip-shaped convex lens array 500 can be in the form of a plane of a positive cylindrical lens, or can be a curved surface curved in the length direction of the strip-shaped convex lens, and the effect to be achieved is that the point light source is stretched in the arrangement direction (x direction) of the point light source, so that the point light source forms the line light source while minimizing or eliminating the influence on the point source 300 in other directions. The cross-sectional dimension of the strip-shaped convex lens can be set as needed, and the strip-shaped convex lens array 500 can be obtained by a process such as 3D printing, extrusion or injection molding. The distance between the strip-shaped convex lens array 500 and the point light source 300 and the distance between the adjacent point light sources 300 are controlled by adjusting the radian and radius of the strip-shaped convex lens. The strip-shaped convex lens array 500 can also achieve the same effect by using optical film. In the embodiment, the strip-shaped convex lens array 500 is a positive cylindrical lens microarray arranged on the optical thin film, specifically, the optical film is an elliptical light diffusing film, and the model used is E-6010. Of course, other models can be selected as long as the point light source 300 is stretched in the arrangement direction (x direction) of the point light source 300. For example, E-1560, E-0160/6001, E-0190 can also be used. In order to achieve a better tensile diffusion effect, when the diffusion film is selected, the stretching ratio in both directions is greater than 4. In the present embodiment, the elliptical light diffusing film is a positive cylindrical lens microarray, the length direction of the positive cylindrical lens is perpendicular to the arrangement direction (x direction) of the point light source 300 when used. The strip-shaped convex lens array 500 in the form of film has a small volume, is easy to install, and can be bent to meet different lamp structure requirements.

In order to further improve the light utilization rate of the LED light fixture, on the plane perpendicular to the length direction of the LED light fixture, the reflection wall 600 is provided on both sides of the point light source 300 for reflecting the lateral light from the point light source 300 to the light incident plane of the strip-shaped convex lens array 500. Of course, the absence of the reflection wall 600 does not affect the use of the LED lighting system, that is, the reflection wall 600 is not an essential functional component, the upper end of the reflection wall 600 extends to the bottom surface of the strip-shaped convex lens array 500, and the point light source 300 is disposed on the printed circuit board 200, most of the light is emitted toward the strip-shaped convex lens array 500, but a small portion of the lateral light is deflected away from the main beam and directed to other directions, and such light is often not utilized, so that the effective utilization rate of the light is reduced, which is a common problem in which the light source emits radiation in a radial manner. When the above design is adopted, it can make good use of the reflection effect to direct the deviated lateral light to the strip-shaped convex lens array 500, thereby concentrating the light beam, and the luminous flux which is truly formed by the strip-shaped convex lens array 500 per unit area is more. Moreover, it improves the effective utilization of light, and reduces the number of point light sources 300 to reduce costs.

At the same time, in order to guide the deflecting light to the direction of the strip-shaped convex lens array 500 as much as possible, according to the light propagation path and the light radiation angle principle of the point light source 300, in the embodiment, the reflection wall 600 and the printed circuit board 200 is disposed at an obtuse angle, and the specific angle is adjusted according to the distance between the point light source 300 and the strip-shaped convex lens array 500.

Embodiment 2

Figure 7:
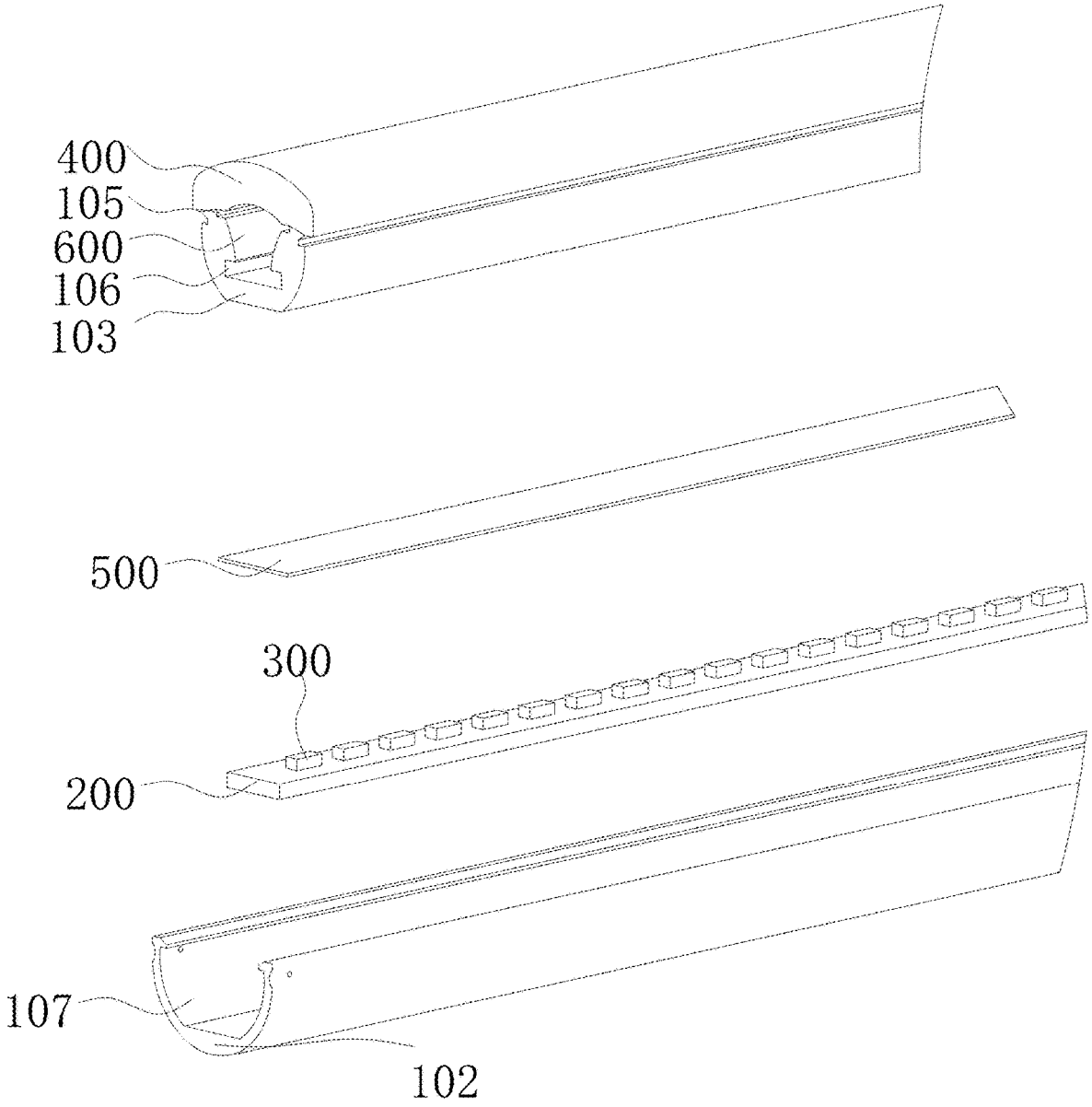
FIG. 7 is an explosion schematic diagram of the partial structure of the line source lighting system of the second embodiment.
Figure 8:
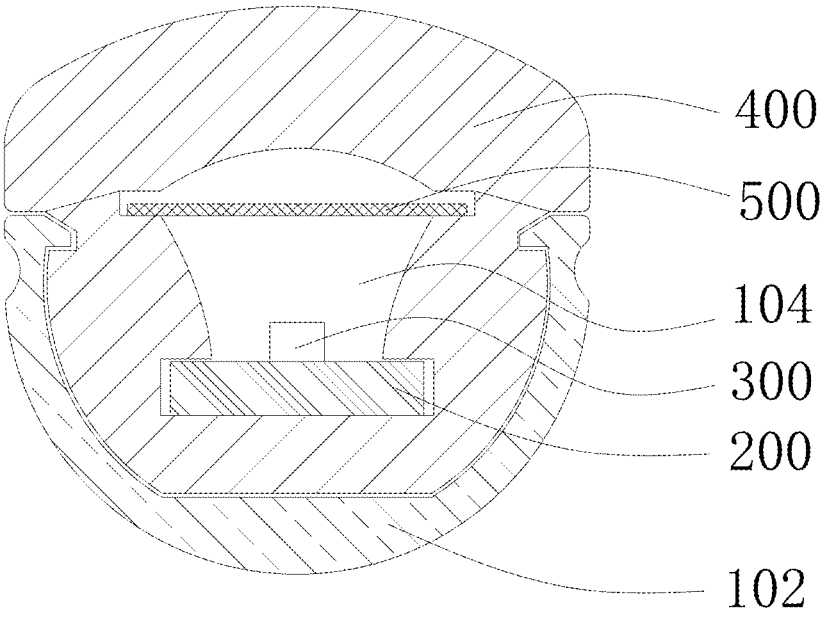
FIG. 8 is the sectional schematic diagram of the line source lighting system of the second embodiment.

As shown in FIGS. 7 and 8, the main components and positional relationship of the line source lighting system of this embodiment are the same as those of the first embodiment, except for the shape of the lens 400 and the connection manner of the respective members.

In this embodiment, the lens 400, the reflection wall 600 and the strip bed plate 103 are integrally formed and enclosed to form an mounting cavity 104. Extrusion process can be used for integral forming. The lens 400 adopts a symmetrical lens and has a radian change on both the inside and outside surfaces, which is easier to manufacture. In the mounting cavity 104, a first mounting groove 105 for fixing the strip-shaped convex lens array 500 is disposed near the lens 400, and the bottom portion of the mounting cavity 104 is provided a second mounting groove 106 for fixing the printed circuit board 200, the side wall between the first mounting groove 105 and the second mounting groove 106 is the reflection wall 600, and the reflection wall 600 is of the arc structure, so that the reflection angle is smaller and the efficiency is higher.

The strip base 102 is made of metal with better heat dissipation effect, and is provided with a curved mounting groove 107 for fixing the strip bed plate 103. The bottom surface of the strip bed plate 103 is a curved surface that fits the curved mounting groove 107, thereby improving the heat dissipation effect.

The strip-shaped convex lens array 500 of the present embodiment also employs an elliptical light diffusing film, and both sides in the width direction are inserted into the first mounting groove 105 for assembly.

Embodiment 3

Figure 9:
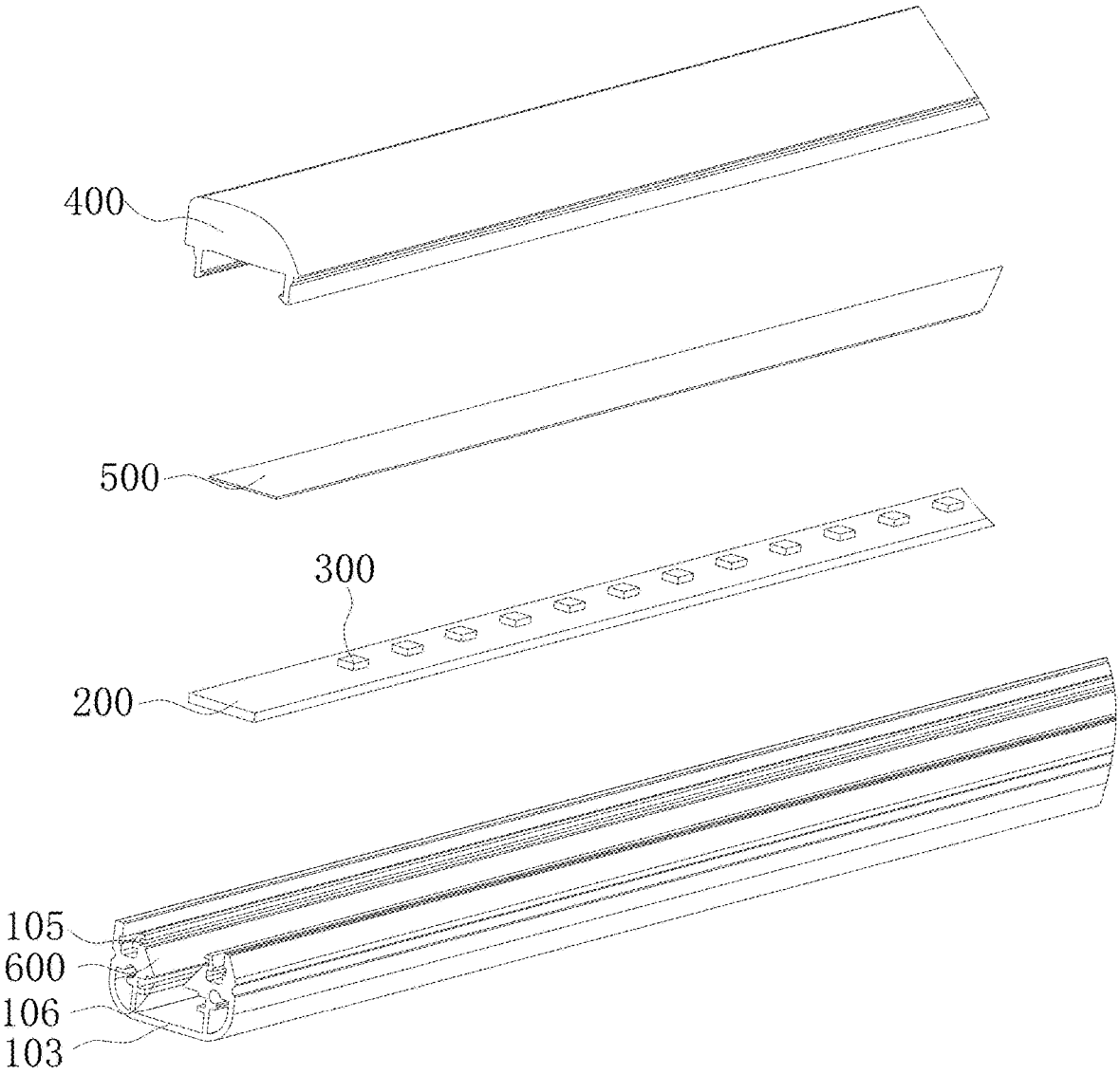
FIG. 9 is an explosion schematic diagram of the partial structure of the line source lighting system of the third embodiment.
Figure 10:
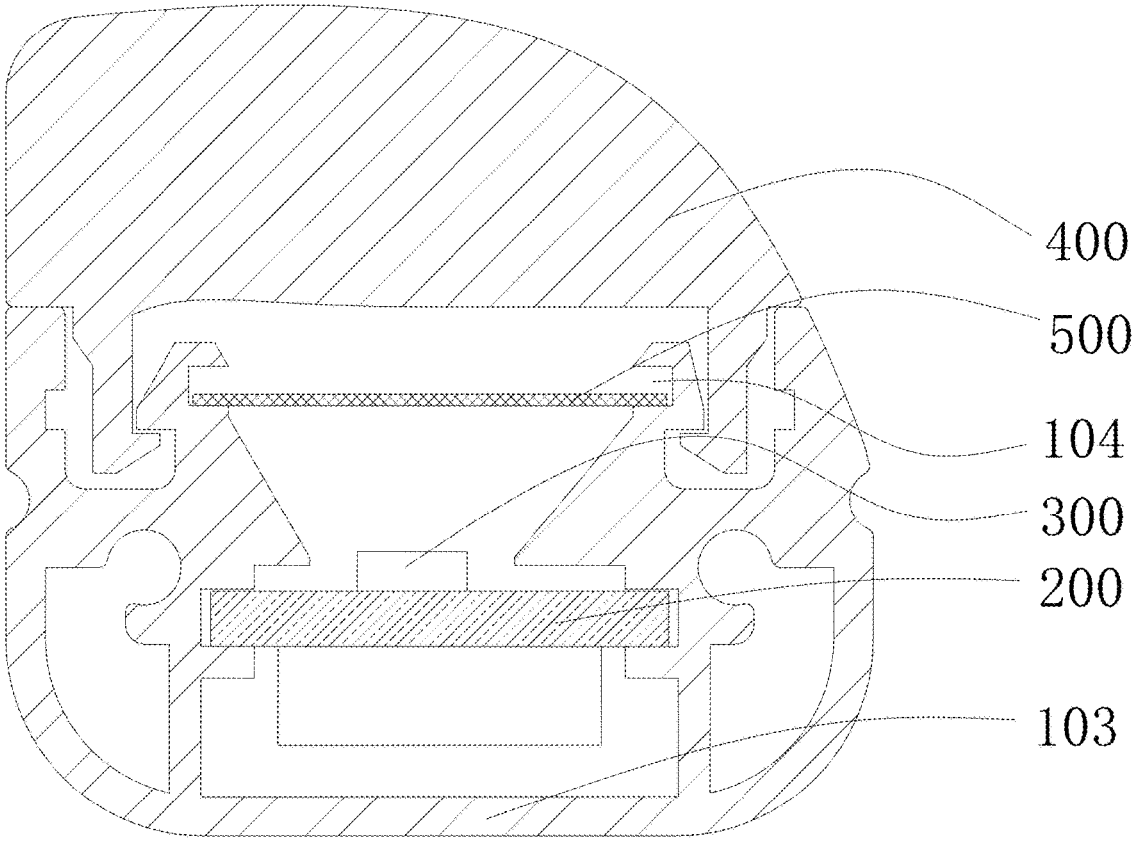
FIG. 10 is the sectional schematic diagram of the line source lighting system of the third embodiment.

As shown in FIGS. 9 and 10, the main components and positional relationship of the line source lighting system in this embodiment are the same as those of the first embodiment, except for the shape of the lens 400 and the connection manner of the respective members.

In this embodiment, the reflection wall 600 and the strip bed plate 103 are integrally formed. The inner side of the top of the two reflection walls 600 is provided with a first mounting groove 105 for fixing the strip-shaped convex lens array 500, and the outer side of the top of the two reflection walls 600 is provided with a buckle structure for fixing the lens 400, and a second mounting groove 106 for fixing the printed circuit board 200 is provided at the bottom of the strip bed plate 103.

The strip-shaped convex lens array 500 of the present embodiment also employs an elliptical light diffusing film, and both sides in the width direction are inserted into the first mounting groove 105 for assembly.

In this embodiment, the lens 400 is a polarizing lens for adjusting the light distribution of the point light source 300 on a plane (y-z plane) perpendicular to the length direction of the lamp holder. The viewing angle in the figure is that the light is polarized to the left.

Embodiment 4

Figure 11:
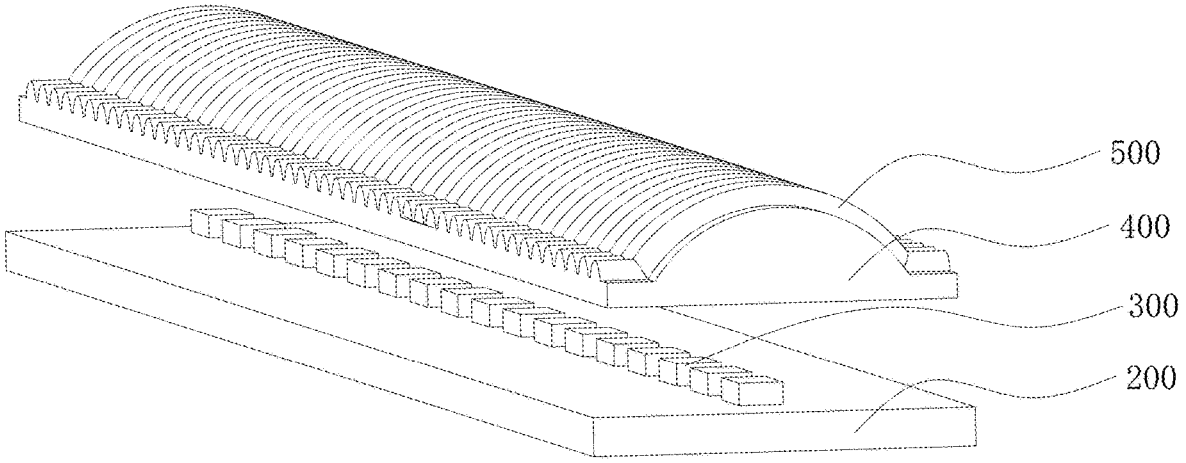
FIG. 11 is a schematic diagram of the principle structure of a line source lighting system of the fourth embodiment.

As shown in FIG. 11, except for the mounting, connecting and positional relationship of the strip-shaped convex lens array 500 and the lens 400, the structure and the connection manner of the remaining components of the embodiment are the same as those of the first embodiment, and the strip-shaped convex lens array 500 and the lens 400 are integrated. The strip-shaped convex lens array 500 is formed on the exit surface of the lens 400.

Embodiment 5

Figure 12:
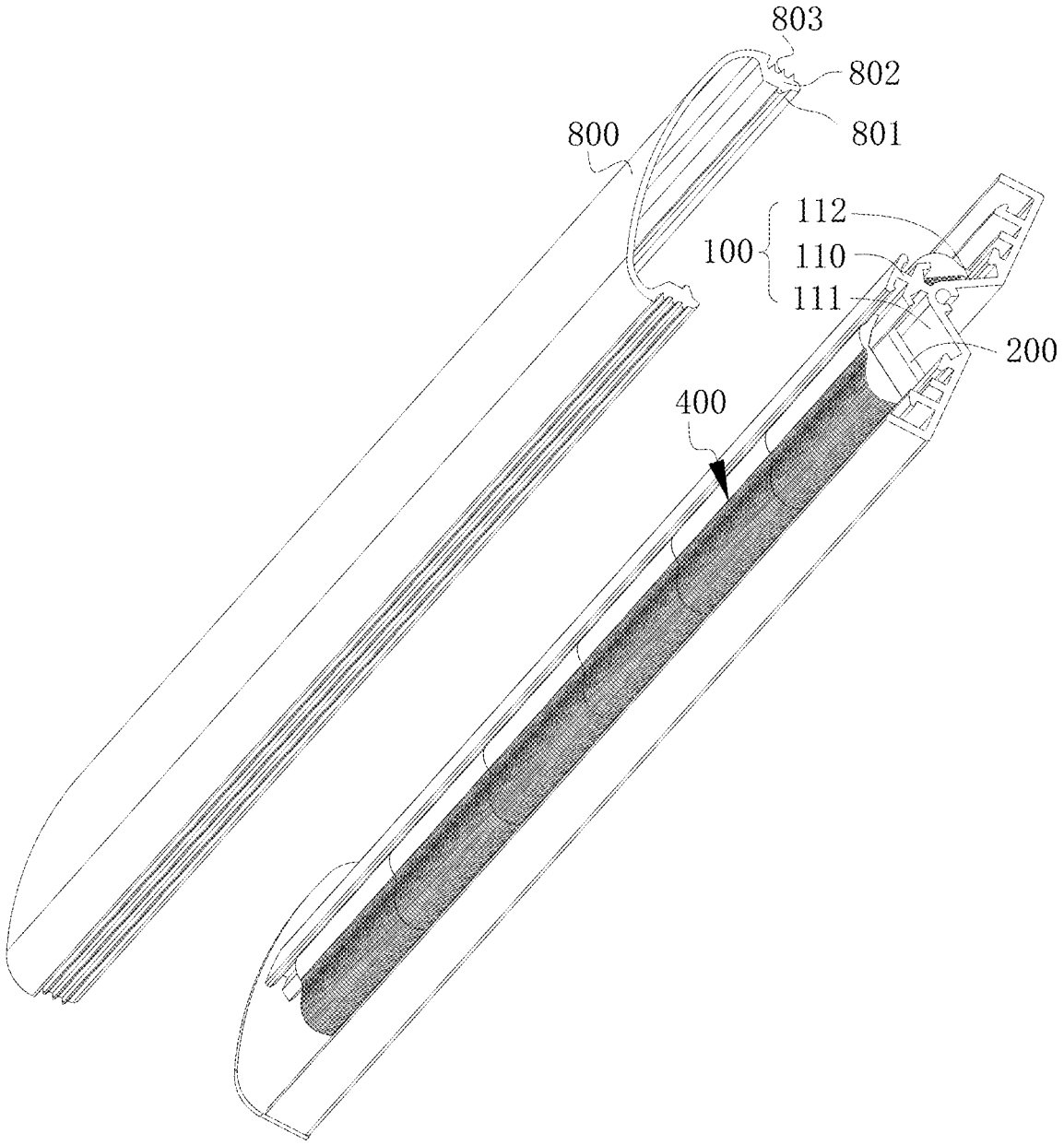
FIG. 12 is a schematic structural view of a line source lighting system of the fifth embodiment.
Figure 13:
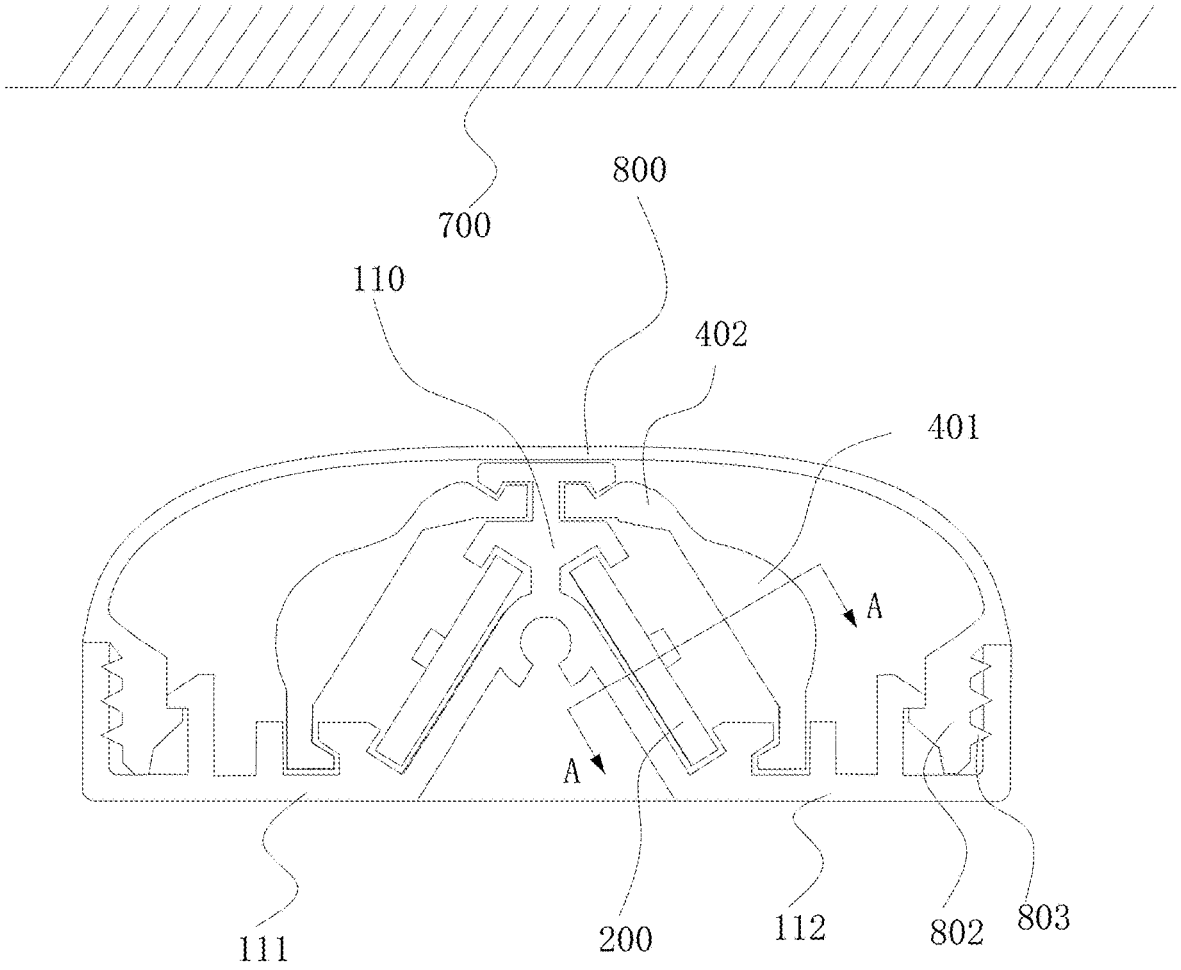
FIG. 13 is a structural schematic view showing another angle of the line source lighting system of the fifth embodiment.
Figure 14:
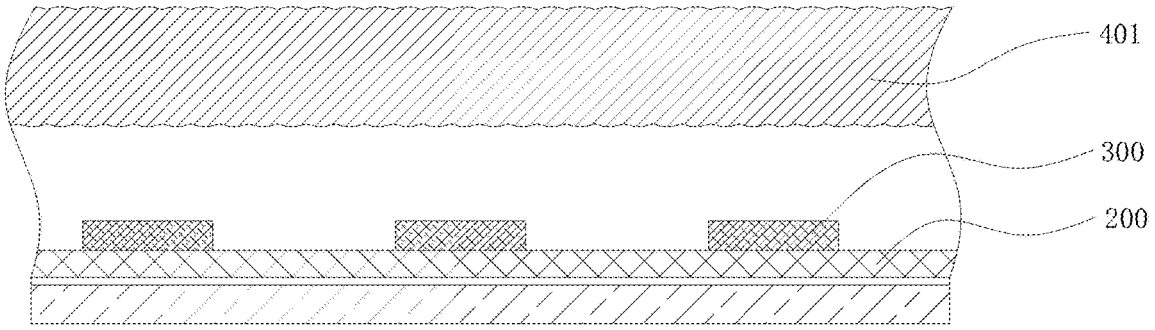
FIG. 14 is a cross-sectional structural view in a-a direction in FIG. 13.

As shown in FIGS. 12 to 14, in the present embodiment, as in the fourth embodiment, the strip-shaped convex lens array 500 and the lens 400 are integrally molded.

The line source illumination lamp of the present embodiment comprises lamp holder 100, printed circuit board 200, a plurality of point light sources 300, lens 400, strip-shaped convex lens array 500, and lamp cover 800.

The lamp holder 100 comprises a first strip base 111 and a second strip base 112 which are separated by a partition fixing plate 110. The circuit board 200 provided with the plurality of point light sources 300 is symmetrically arranged with two pieces, respectively mounted on the first strip base 111 and the second strip base 112. Correspondingly, the lens 400 is provided with two symmetrical ones, which are respectively installed in the first strip base 111 and the second strip base 112. The outer side of the first strip base 111 and the second strip base 112 are connected to the two sides of the lamp cover 800 through a clasp structure, and the outer side of the clasp structure 801 disposed on both sides of the lamp cover 800 is provided with a soft seal 802. The soft seal 802 is interference fit with the inner side wall of the first strip base 111 and the second strip base 112. In the embodiment, the soft seal 802 is provided with a serration 803 on a side toward the inner side wall of the strip bases. The serration 803 can increase the contact tightness between the soft seal 802 and the inner wall of the strip bases, thereby providing a good waterproof effect.

The lens 400 comprises a light transmission main part 401 for focusing most of the light of the point light source 300, and a light transmission secondary part 402 disposed at a certain angle with one side of the light transmission main part 401 to guide a small part of the light of the point light source 300.

The light transmission main part 401 projects most of the light to the distal end of the illuminated surface 700, and the light transmission secondary part 402 directs a small part of the light to the proximal end of the illuminated surface 700. On the plane perpendicular to the length direction of the lamp holder, the light incident surface of the light transmission secondary part 402 and the light incident surface of the light transmission main part 401 are straight lines, and the angle formed by the intersecting straight lines is 90°-160°.

The light transmission secondary part 402 is far away from the point light source 300, and the light incident surface is provided with a strip-shaped convex lens array 500; the light transmission main part 401 is close to the point light source 300. In order to improve the effect of presenting line light source, both the light incident surface and the light emitting surface are equipped with a strip-shaped convex lens array 500.

Embodiment 6

Figure 15:
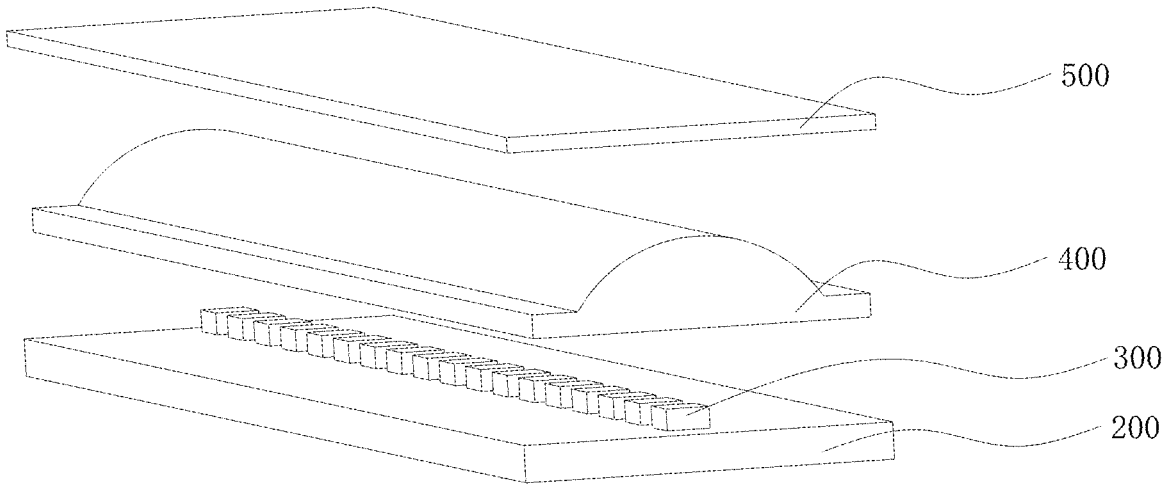
FIG. 15 is a schematic view showing the principle structure of the line source lighting system of the sixth embodiment.

As shown in FIG. 15, in this embodiment, the lens 400 is located between the strip-shaped convex lens array 500 and the printed circuit board 200, and the distance between the strip-shaped convex lens array 500 and the point light source 300 is increased to improve the imaging of the line light source. The shape of the lens 400 can be designed as needed, and can be a symmetric convex lens, a polarizing lens, or an anisotropic lens.

Embodiment 7

Figure 16:
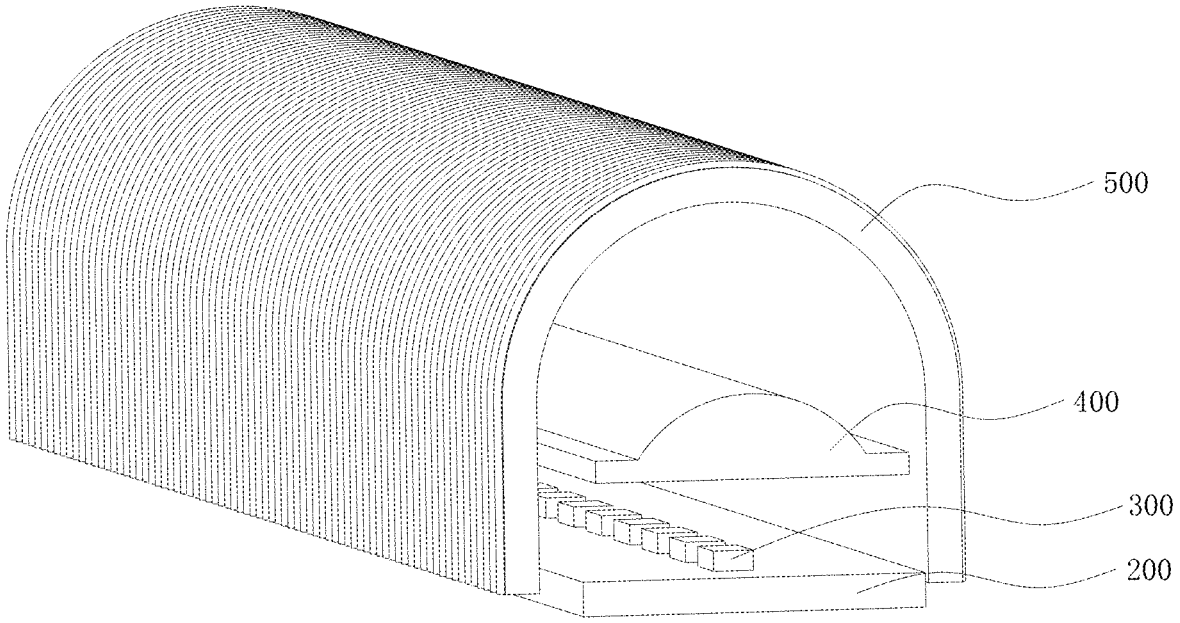
FIG. 16 is a schematic view showing the principle structure of the line source lighting system of the seventh embodiment.

As shown in FIG. 16, in this embodiment, the lens 400 is disposed between the strip-shaped convex lens array 500 and the printed circuit board 200, and the strip-shaped convex lens array 500 is disposed as a lamp cover. In this embodiment, the strip-shaped convex lens array 500 is a curved surface in which the strip-shaped convex lens is curved in the longitudinal direction.

Embodiment 8

Figure 17:
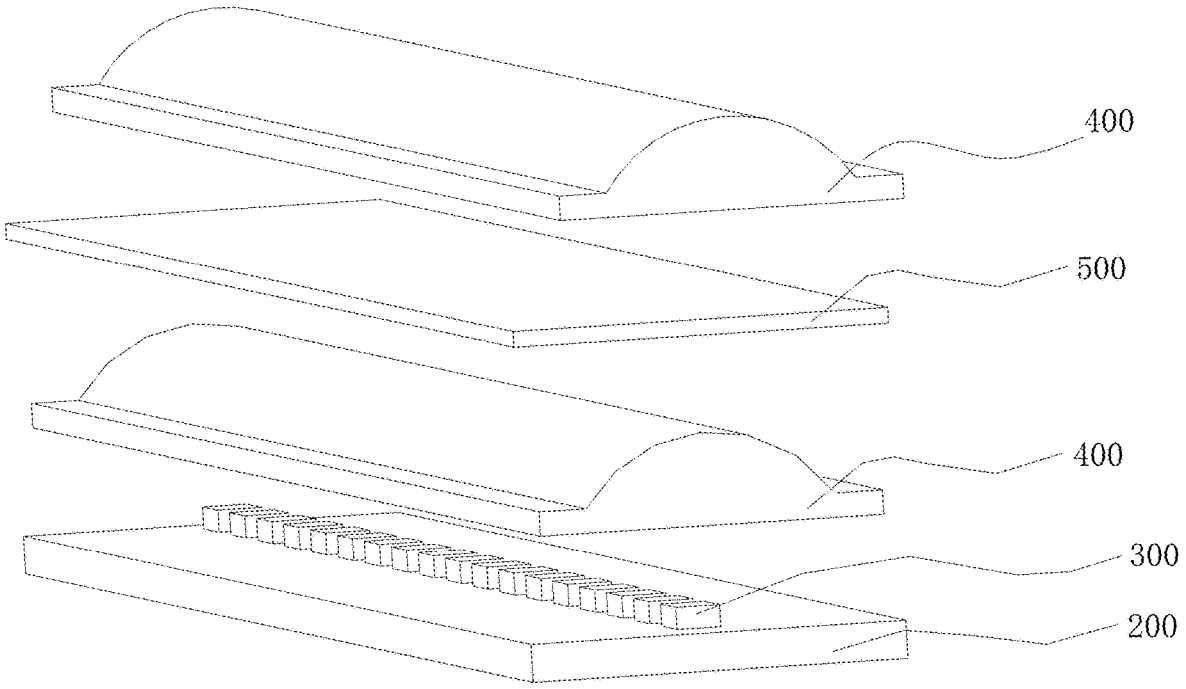
FIG. 17 is a schematic view showing the principle structure of a line source lighting system of the eighth embodiment.

As shown in FIG. 17, in this embodiment, the lens 400 is provided with two, and the strip-shaped convex lens array 500 is disposed between the two lenses 400. The two lenses 400 can cooperate to achieve a higher light distribution. The shape of the lens 400 can be designed as needed, and can be a symmetric convex lens, a polarizing lens, or an anisotropic lens.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A line source lighting system, comprising:

a lamp holder (100);

a printed circuit board (200), disposed on the lamp holder (100);

a plurality of point light sources (300), disposed spaced apart from each other along a lengthwise direction of the lamp holder on a light source mounting surface of the printed circuit board (200);

and at least one lens (400), disposed on the lamp holder (100) and located in a light-emitting direction of the point light source (300) for adjusting light distribution of the point light source (300) on a plane perpendicular to the lengthwise direction of the lamp holder;

further comprising:

a strip-shaped convex lens array (500), disposed on the lamp holder (100) and located in the light-emitting direction of the point light source (300) and arranged along the lengthwise direction of the lamp holder (100) for converting each point light source (300) into a plurality of continuous sub-point light sources, the sub-point light sources converted by the adjacent point source (300) are connected or coincident;

wherein the lens (400) is located between the strip-shaped convex lens array (500) and the printed circuit board (200).

2. The line source lighting system as claimed in claim 1, wherein the strip-shaped convex lens array (500) is a positive cylindrical lens array.

3. The line source lighting system as claimed in claim 1, wherein the strip-shaped convex lens array (500) is a curved surface that is curved in the length direction of the strip-shaped convex lens.

4. The line source lighting system as claimed in claim 1, wherein the strip-shaped convex lens array (500) is a positive cylindrical lens microarray disposed on an optical film.

5. The line source lighting system as claimed in claim 1, wherein the strip-shaped convex lens array (500) is located between the lens (400) and the printed circuit board (200).

6. The line source lighting system as claimed in claim 1, wherein at least two lenses (400) are provided, and the strip-shaped convex lens array (500) is located between any two lenses (400).

7. The line source lighting system as claimed in claim 1, wherein the strip-shaped convex lens array (500) is disposed as a lamp cover.

8. The line source lighting system as claimed in claim 1, wherein the strip-shaped convex lens array (500) and the lens (400) are integrally formed.

9. The line source lighting system as claimed in claim 8, wherein the strip-shaped convex lens array (500) is disposed on a surface on which the light emitting surface of the lens (400) is located.

10. The line source lighting system as claimed in claim 8, wherein the strip-shaped convex lens array (500) is disposed on the surface where the light incident surface of the lens (400) is and on the surface where the light emitting surface is.

11. The line source lighting system as claimed in claim 9, wherein the lens (400) comprises a light transmission main part (401) for focusing the light of the point light source (300), and a light transmission secondary part (402) disposed at a certain angle with one side of the light transmission main part (401) to guide a part of the light of the point light source (300).

12. The line source lighting system as claimed in claim 11, wherein the light transmission main part (401) projects a majority of the light to the distal end of the illuminated surface (700), and the light transmission secondary part (402) directs a small part of the light to the proximal end of the illuminated surface (700).

13. The line source lighting system as claimed in claim 11, wherein on a plane perpendicular to the length direction of the lamp holder, the light incident surface of the light transmission secondary part (402) and the light incident surface of the light transmission main part (401) are straight lines, and the angle formed by the intersecting straight lines is 90°~160°.

14. The line source lighting system as claimed in claim 11, wherein the light incident surface of the light transmission secondary part (402) is provided with the strip-shaped convex lens array (500), and the light incident surface and the light emitting surface of the light transmission main part (401) are each provided with the strip-shaped convex lens array (500).

15. The line source lighting system as claimed in claim 11, wherein the printed circuit board (200) provided with the plurality of point light sources (300) is symmetrically arranged with two pieces, correspondingly, the lens (400) are two symmetrical lenses.

16. The line source lighting system as claimed in claim 15, wherein the angle between the optical axes of the point light sources (300) on the two printed circuit boards (200) is obtuse.

17. The line source lighting system as claimed in claim 1, wherein the lens (400) is a polarized lens.

18. The line source lighting system as claimed in claim 1, wherein the lens (400) is a symmetrical lens.

19. The line source lighting system as claimed in claim 1, wherein on the plane perpendicular to the length direction of the LED light fixture, the reflection wall (600) is provided on both sides of the point light source (300) for reflecting the lateral light from the point light source (300) to the light incident plane of the strip-shaped convex lens array (500).

* * * * *